United States Patent [19]

Klug

[11] 4,119,127

[45] Oct. 10, 1978

[54] SHOULDER BAG

[75] Inventor: Gottfried Klug, Bobigny, France

[73] Assignee: Pelzer-Kirst GmbH and Co., Kirn, Fed. Rep. of Germany

[21] Appl. No.: 823,128

[22] Filed: Aug. 9, 1977

[51] Int. Cl.[2] ..... B65D 33/06; B65D 33/16

[52] U.S. Cl. ..... 150/3; 150/12; 150/52 G; 224/8 R

[58] Field of Search ..... 150/3, 52 R, 52 G, 7, 150/28 R, 33, 12; 190/43, 48, 51, 52; 224/8 R, 9 R, 46 R

[56] References Cited

U.S. PATENT DOCUMENTS

| | | | |
|---|---|---|---|
| 1,771,168 | 7/1930 | Droutman | 150/28 R |
| 2,340,964 | 2/1944 | Kassner | 150/3 |
| 2,533,850 | 12/1950 | Syracuse | 190/52 |
| 3,963,103 | 6/1976 | Cowen | 150/52 G |
| 4,018,369 | 4/1977 | Jaeger | 224/8 R |

FOREIGN PATENT DOCUMENTS

| | | | |
|---|---|---|---|
| 56,619 | 7/1952 | France | 150/28 R |
| 421,052 | 5/1947 | Italy | 150/28 |

*Primary Examiner*—Herbert F. Ross
*Attorney, Agent, or Firm*—Hans Berman

[57] ABSTRACT

A shoulder bag has a tubular carrying strap whose hollow end portions are in communication with the hollow receptacle of the bag.

8 Claims, 6 Drawing Figures

SHOULDER BAG

The present invention relates to an improved bag with a carrying strap enabling the bag to be slung over one shoulder or to be carried on both shoulders for transporting various objects, especially sports articles, such as tennis racquets.

Bags of this general type comprise a front wall, a rear wall and two side walls interconnecting the front and rear walls, the bag walls being of pliable material and defining a hollow receptacle for the objects to be transported. The bottom of the bag is usually formed by fastening the lower edges of the front and rear walls together, for instance by a seam. An upper closure interconnects the upper edges of the bag walls and may be suitably opened and closed, for instance by means of a slide fastener or other suitable closing means. The carrying strap normally is a fabric or like pliable material band connected to the side walls of the bag or extensions thereof.

Conventional bags of this type are not adapted to transporting tennis racquets or articles of similar shape, not only because they are not properly dimensioned for this purpose but primarily because they have no receptacle for the handle of the racquet.

This and other disadvantages are overcome in accordance with this invention by providing a carrying strap of pliable material with end portions connected to the side walls of the bag, at least the end portions of the strap defining hollow receptacles in communication with the hollow receptacle defined by the bag walls. The hollow receptacles of the tubular strap end portions lead into the hollow receptacle of the bag and thus enlarge the bag receptacle at both sides in an upward direction. All three receptacles constitute a single pocket.

The above and other objects, advantages and features of the invention will become more apparent from the following detailed description of a now preferred embodiment thereof, taken in conjunction with the accompanying drawing wherein FIG. 1 is a view of the bag slung over the shoulder of a person;

Figures 1, 2, 3, 4, 5, 6:
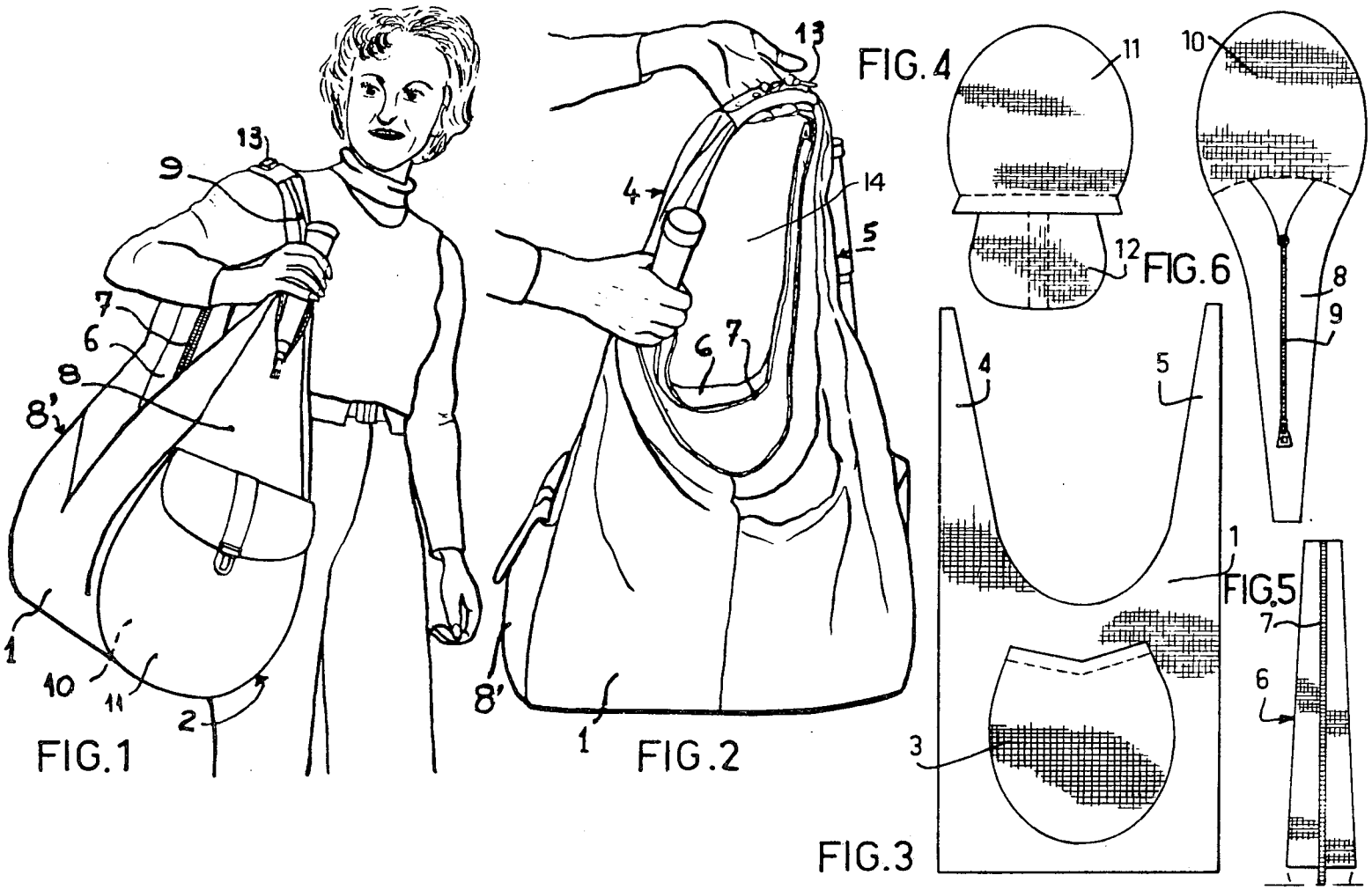
FIG. 2 shows a front view of the bag as a tennis racquet is being inserted thereinto.
FIG. 3 is a plan view of a blank for forming the front wall of the bag.
FIG. 4 is a like view of a blank for forming an outer pocket.
FIG. 5 is a like view of one half of a blank for forming the upper closure of the bag.
FIG. 6 is a like view of a blank for forming a side wall, with its elongated extension and interior compartment.

The walls and carrying strap panels of the bag are made of any suitable pliable material, such as canvass, soft leather, plastic film, fabric or the like.

In the illustrated embodiment, the bag comprises front wall 1 and rear wall 2, and two like side walls 8, 8' interconnecting the like front and rear walls. The bag walls define a hollow receptacle, the lower edges of the front and rear walls being fastened together to form the bottom of the bag and an upper closure 6 interconnecting the upper edges of the front and rear walls.

As best illustrated in FIG. 3, each front and rear wall is comprised of a blank or panel having two like trapezoidal elongated extensions 4 and 5 projecting from opposite sides of the wall panel. If desired and as shown in FIG. 3, front wall 1 of the bag may have an outer pocket 3 for storing small items.

As shown in FIG. 5, upper bag closure 6 and its lateral extensions to be described hereinafter consist of two like panel parts defining a slit opening along the entire length thereof, which may be closed by a fastener means 7 connecting the two like panel parts.

As appears from FIG. 6, the side walls of the bag are comprised of a blank or panel essentially having the shape and dimensions of a tennis racquet. The lower part of the side walls has an interior compartment 10 having the shape and dimensions of the substantially elliptical portion of a tennis racquet while their upper part is elongated in a trapezoidal extension accommodating the handle of the racquet.

The bag walls may have additional pockets formed by blanks, such as shown at 11 in FIG. 4, the pockets being closable by flaps 12.

In accordance with the present invention, the carrying strap of the bag has tubular end portions connected to side walls 8, 8' and the hollow receptacles defined by these end portions are in communication with the hollow receptacle defined by the bag walls. As will be appreciated from FIGS. 1 and 2, these hollow strap end portions are constituted by four substantially trapezoidal panels. Two of the panels of each strap end portion consist of like elongated extensions 4 and 5 of the front and rear walls. A third panel of each strap end portion consists of the trapezoidal extension of side walls 8, 8', the latter elongated extension interconnecting the like elongated extensions 4, 5. The fourth panel of each strap end portion consists of the lateral extensions of upper closure 6 which interconnects the front and rear walls of the bag between the end portions of the strap, the lateral trapezoidal extensions of the upper closure interconnecting the like elongated extensions 4, 5 on the inside of the strap. In this manner, when the wall and closure blanks are sewn or otherwise fastened together, they will form the hollow end portions of a carrying strap which are in communication with the hollow receptacle defined by the bag walls and closure. These strap end portions define downwardly diverging hollow receptacles in communication with the hollow bag receptacle and, more particle with its side compartments 10. The upper closure 6 and elements of the strap extend in a closed loop about a passage 14 transverse to the front and rear walls and dimensioned to receive at least one arm of the wearer.

The fastener means 7 for closing the slit opening in upper closure 6 toward the passage 14 preferably is a slide fastener comprising two slides so that each side of the carrying strap may be opened and closed independently. When it is desired to insert a tennis racquet into the bag, as shown in FIG. 2, one of the slides is opened to enable the racquet to be slipped into compartment 10 while its handle will project into the hollow receptacle defined by the adjacent strap end portion. Preferably, the elongated extensions of the side walls have a vertical slit aperture opening away from the passage 14 at least along an upper portion thereof remote from the side walls and this slit opening may be opened and closed by slide fastener 9. When the racquet is inserted into compartment 10, the slit opening in the side wall extension is also opened to permit the end of the racquet handle to project therethrough, as indicated in FIG. 1. It is preferred to provide two slides so that they may be coordinated in a manner permitting the projecting racquet handle to be held in a desired position.

In the preferred embodiment illustrated herein, the elongated extensions of the bag walls, which form three of the trapezoidal panels constituting the end portions of the carrying strap, are formed integrally with the walls. Similarly, the lateral extensions of upper closure 6 are integral therewith.

In the illustrated embodiment, the bag is designed primarily for transporting tennis racquets and its walls are correspondingly shaped and dimensioned, compartments 10 being capable of holding the elliptical portion of a tennis racquet with or without a tensioning frame while the hollow end portions of the carrying strap can accommodate at least a portion of the racquet handle. The elliptical portion of the racquet may be held in compartment 10 by means of a band or compartment wall dividing the compartment from the hollow receptacle of the bag, the elliptical racquet portion simply being slid into the compartment between the band or compartment wall and the side wall of the bag.

The two symmetrical carrying strap parts extending from each side wall of the bag are fastened together, at which point spring safety hook 13 is mounted intermediate the end portions of the carrying strap to enable the bag to be suspended on a hook or the like.

What I claim is:

1. A bag comprising:

(a) a hollow receptacle including a front wall, a rear wall, and two side walls interconnecting said front and rear walls;

(b) an elongated carrier strap including two end portions connected to said side walls respectively, (1) said walls and said end portions consisting essentially of pliable material, (2) said receptacle and said strap defining a passage open transverse to said front and rear walls, and jointly extending in a closed loop about said passage, (3) at least one of said end portions being tubular, and the hollow interior of said at least one end portion communicating with said receptacle, (4) said receptacle being formed with an opening toward said passage, and (5) said one portion being formed with an elongated aperture directed away from said passage to receive an elongated portion of an article carried by said receptacle.

2. The bag of claim 1, further comprising upper closure means for interconnecting the front and rear walls in said passage between said end portions, and for thereby closing said opening.

3. The bag of claim 2, wherein each one of the strap end portions is constituted by four panels, two of the panels of each strap end portion consisting of like elongated extensions of the front and rear walls, a third one of the panels of each strap end portion consisting of an elongated extension of a respective one of the side walls, the latter elongated extension interconnecting the like elongated extensions, and a fourth one of the panels of each strap end portion consisting of a lateral extension of said upper closure means.

4. The bag of claim 3, wherein the upper closure means and lateral extensions thereof include of two like panel parts defining a slit opening along the entire length thereof, and further comprising fastener means for closing the slit opening.

5. The bag of claim 3, wherein the fastener means is a slide fastener comprising two slides.

6. The bag of claim 4, further comprising a fastener means for closing said aperture.

7. The bag of claim 6, wherein the fastener means is a slide fastener comprising two slides.

8. The bag of claim 6, wherein one of the side walls has an interior compartment in communication with said hollow interior, the interior compartment having a shape and dimensions of the substantially elliptical portion of a tennis racquet.

* * * * *